United States Patent [19]

Plevjak

[11] 4,195,897

[45] Apr. 1, 1980

[54] COLLISION ACTIVATED, AUTOMATIC ELECTRICITY DISCONNECTOR FOR VEHICLES

[76] Inventor: John G. Plevjak, 34 Hay Rd., St. George Ter., Shirley, N.Y. 11967

[21] Appl. No.: 956,208

[22] Filed: Oct. 30, 1978

[51] Int. Cl.[2] ..... H01R 13/02

[52] U.S. Cl. ..... 339/45 R; 180/283; 339/224

[58] Field of Search ..... 339/10, 45, 46, 111, 339/224, 228; 180/103 A

[56] References Cited

U.S. PATENT DOCUMENTS

| | | | |
|---|---|---|---|
| 1,976,649 | 10/1934 | Aoki | 339/228 |
| 3,829,823 | 8/1974 | Dumesnil | 339/45 R |
| 3,830,331 | 8/1974 | Piazza | 339/45 R |
| 4,000,408 | 12/1976 | McCartney | 180/103 A |

*Primary Examiner*—Joseph H. McGlynn

[57] ABSTRACT

An accessory mounted in a vehicle and through which a negative side of the circuit from the battery flows; the accessory including an electricity conductor integral with a weight which in case of a sudden stop, such as during a collision due to momentum flies loose from between contactor of the circuit, so to break the same.

1 Claim, 3 Drawing Figures

30
31
11
10
29
32

27
29
23
26
28
21
14
18
10
19
12
13
15
16
20
17
24
25

14
16
17
15
12
13
19
18
20
21
22

COLLISION ACTIVATED, AUTOMATIC ELECTRICITY DISCONNECTOR FOR VEHICLES

BACKGROUND OF THE INVENTION

This invention relates to safety devices for automotive vehicles.

It is well known that many fatalities in car accidents are due to a vehicle catching on fire, such as can occur when in a gasoline line or tank is ruptured during a collission and electric sparks are present so to ignite the spilling gasoline. This deadly situation is, accordingly, in want of an improvement.

SUMMARY OF THE INVENTION

Therefore, it is a principal object of the present invention to provide an accessory mountable within the electric circuit of an automobile, and which automatically disconnects the circuit in case of any violent stop of the vehicle, such as might occur during a collision impact, so that all sparks are instantly ceased to be made.

Another object is to provide a safety accessory that can be quickly and easily mounted in any vehicle, and which can be easily mounted in any vehicle, and which can be easily reset after being activated, so that it is always protecting the Vehicle from a fire.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DESCRIPTION OF THE PREFERRED EMBODIMENTS

Figure 1:
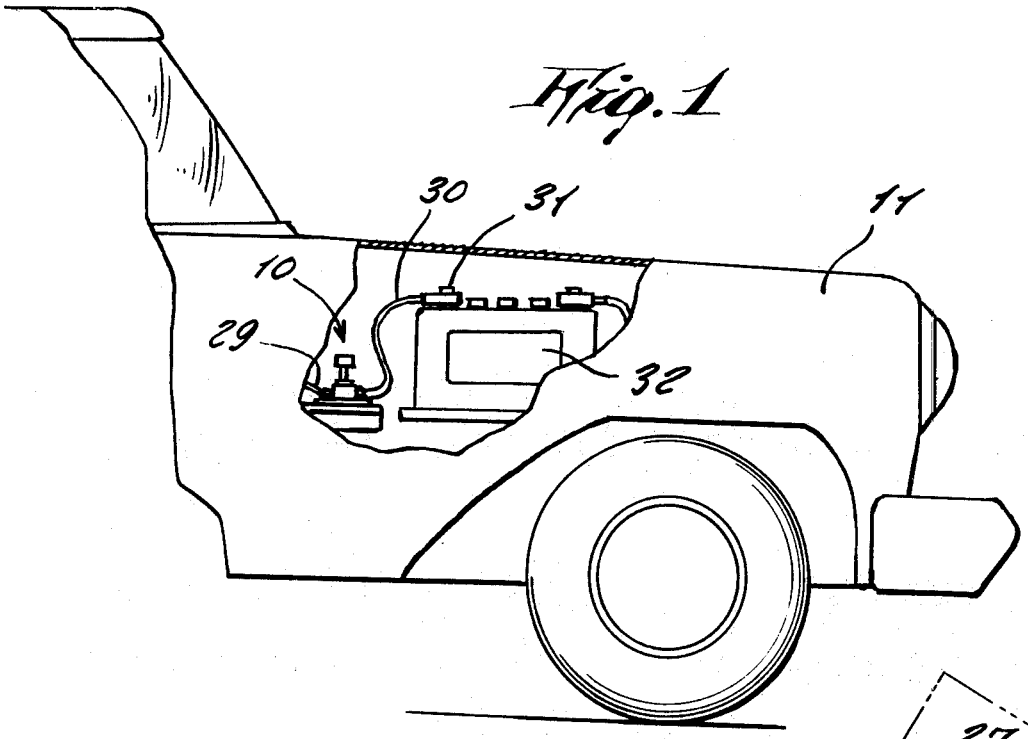
FIG. 1 is a side view of an automobile shown partly broken away so to show the invention installed therein.
Figure 2:
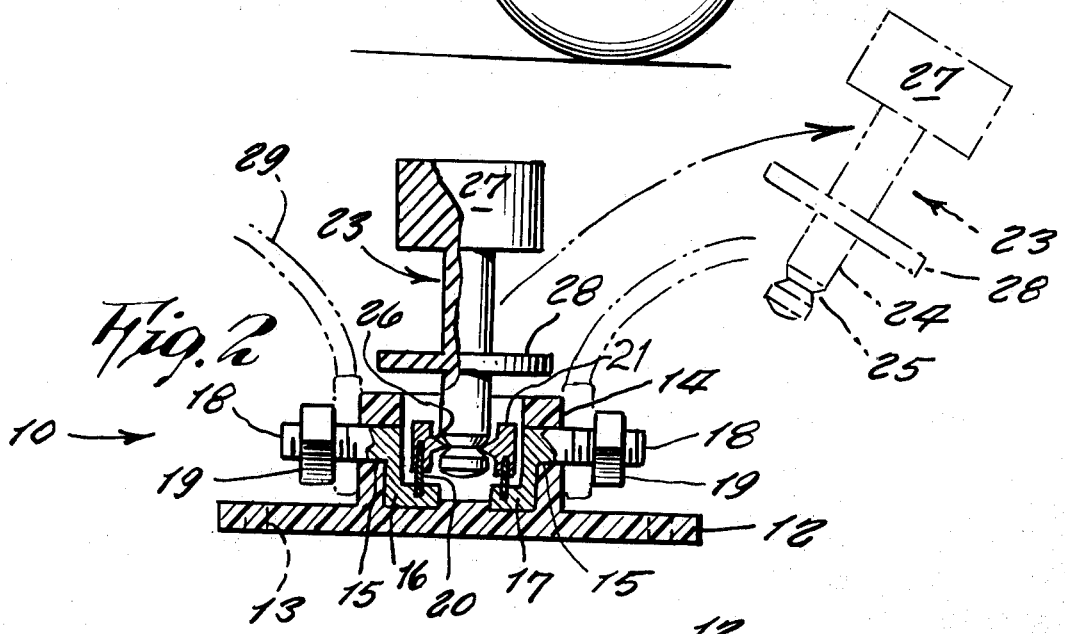
FIG. 2 is an enlarged side cross sectional view of the invention.

Referring now to the drawing in greater detail, the reference numeral 10 represents a collision activated, automatic electric disconnector device according to the present invention, and which is mountable in an automotive vehicle 11, being electrically connected in series within the grounded side of the vehicle electricity circuit.

The disconnector 10 includes a base 12 molded of electrical insulation material. Holes 13 through the base serve to receive mounting screws or bolts in order that the disconnector can be rigidly and stationarily affixed to the vehicle body or frame.

An upward collar 14 integrally formed with the base, has an opening 15 on diametrically opposite sides thereof, and through each of which metal terminals 16 and 17 are inserted. The outward end of each terminal comprises a threaded shank 18 on which a nut 19 is engaged.

Figure 3:
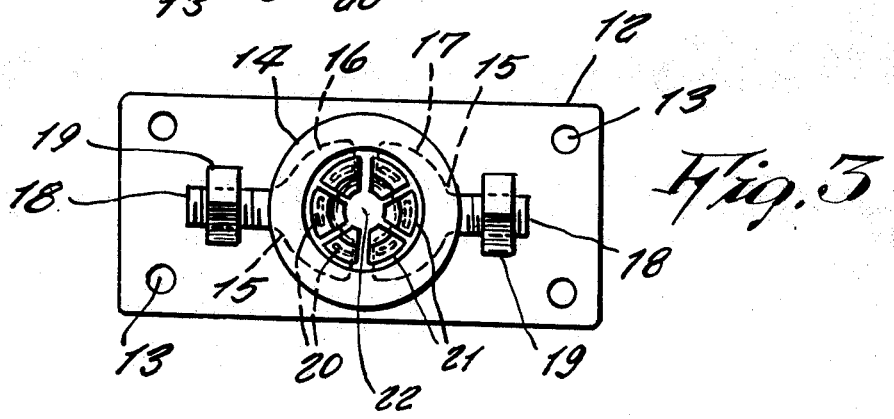
FIG. 3 is a top view of the invention base without the weighted contact.

The inner end of the terminals, inside the collar, each include a semi-circular row of upwardly extending metal leaf springs 20 imbedded therein, and the upper ends of the leaf springs are imbedded within metal blocks 21 arranged accordingly in a semi circle, as clearly shown in FIG. 3.

The semi-circular row of blocks on diameterically opposite sides of the collar central opening each form a resilient clamp around a central small opening 22 into which a conductor 23 is snap fitted.

The conductor comprises a solid copper pin 24 which near its lower end includes an annular groove 25 so that a wedge shaped lip 26 on a side of each block 21 will snap fit therein, and thus securely hold the conductor.

The conductor also includes an enlarged weight 27 formed at the upper end of the pin.

A relatively thin flange 28 is formed around an intermediate portion of the pin and which is located a short distance above the upper edge of the collar 14. The flange diameter is approximately the same as the outer diameter of the collar.

The disconnector 10 is installed in the ground cable 29 circuit, one end of which is connected to the vehicle's while the other end is connected to terminal 16. A negative cable 30 is connected at one end to the negative terminal 31 of Vehicle's battery 32 while the other end of cable 30 is connected to terminal 17. The connections to terminals 16 and 17 are tightly secured by means of the nuts 19. It is thus evident that an electric circuit through the battery must also pass transversly through the pin 24. It is also evident that removal of this pin will break this circuit.

In case of a sudden vehicle stop, such as during a collision, the inertia momentum force against the weihg 27 will cause the pin to be pulled out of the opening 22 between the blocks 21, thus breaking the circuit. At initial vehicle impact, the weight causes the pin to tilt over from a vertical position so that the flange 28 strikes against the top edge of the collar 14 and serves as a fulcrum around which the pin 24 pivots so that the pin is thus pulled upwardly out of the opening 22. A lanyard not shown may be secured between conductor 23 and the vehicle, so that the conductor will not be lost.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A collision activated, automatic electric disconnect device for vehicles, comprising in combination, a base integral with a collar made of insulated material, means for mounting said base stationarily on said vehicle, means for connecting said disconnect device in the battery circuit of said vehicle and connectable means for connecting a weighted contact to said disconnect device such that a collision of said vehicle will cause said weighted contact to be disconnected from said disconnect device, thereby interrupting said battery circuit, wherein said connection means comprises a semi-circular resilient clamp around a central opening, and a weighted conductor snap fitted in said central opening, wherein said conductor comprises a conductive pin having an enlarged weight at its upper end and fulcrum means at its intermediate portion, a lower end of said pin having means to snap fit in said clamps.

* * * * *